United States Patent [19]

Dorsey et al.

[11] Patent Number: 4,788,964

[45] Date of Patent: Dec. 6, 1988

[54] MAGNETICALLY HINGED SMOKE SHIELD ASSEMBLY FOR AN OVER-THE-RANGE OVEN

[75] Inventors: Paul S. Dorsey, Johnson Township, Champaign County; Edward F. Ponikwia, Harrison Township, Montgomery County, both of Ohio

[73] Assignee: Whirlpool Corporation, Benton Harbor, Mich.

[21] Appl. No.: 181,161

[22] Filed: Apr. 13, 1988

[51] Int. Cl.[4] ..... F24C 15/20

[52] U.S. Cl. ..... 126/299 R; 126/299 D; 126/303; 16/DIG. 14

[58] Field of Search ..... 126/24, 42, 299 R, 299 D, 126/299 C, 300–303, 211, 312, 80, 81, 299 F, 201, 202; 98/115.1, 115.3, 115.4; 16/320, DIG. 14; 248/206.5, 309.4; 292/251.5; 297/97 D

[56] References Cited

U.S. PATENT DOCUMENTS

| | | | |
|---|---|---|---|
| 931,312 | 8/1909 | Kahn | 126/303 |
| 1,954,257 | 4/1934 | Nessel | 126/301 |
| 2,603,530 | 7/1952 | Jones | 248/206.5 |
| 2,855,242 | 10/1958 | Holmes | 248/206.5 |
| 3,180,331 | 4/1965 | Jenn et al. | 126/21 A |
| 3,559,636 | 2/1971 | Marino | 126/299 D |
| 3,564,990 | 2/1971 | Smedes | 98/115.3 |
| 3,912,473 | 10/1975 | Wilkins | 126/299 D |
| 4,155,343 | 5/1979 | Hartman | 126/24 |

FOREIGN PATENT DOCUMENTS

| | | | |
|---|---|---|---|
| 2508986 | 9/1976 | Fed. Rep. of Germany | 126/299 R |
| 2528274 | 12/1976 | Fed. Rep. of Germany | 126/299 R |
| 3438404 | 3/1986 | Fed. Rep. of Germany | 16/DIG. 14 |

*Primary Examiner*—James C. Yeung

*Attorney, Agent, or Firm*—Mason, Kolehmainen, Rathburn & Wyss

[57] ABSTRACT

A smoke shield assembly for an over-the-range oven includes a magnetically hinged deflecting shield movable between stored and in use positions. The assembly includes a metal base secured to a forwardly positioned bottom metal member of the over-the-range oven by four magnets. Two of the magnets securing the base to the oven also form a magnetic hinge that secures the deflecting shield to the base. The two other magnets securing the base to the oven further maintain the deflecting shield in the stored position. The deflecting shield is metal having a generally U-shaped pivot end magnetically secured to the base. The pivot end may have an unhemmed pivot edge or a hemmed pivot edge to ease pivoting between the stored and in use positions.

13 Claims, 1 Drawing Sheet

MAGNETICALLY HINGED SMOKE SHIELD ASSEMBLY FOR AN OVER-THE-RANGE OVEN

BACKGROUND OF THE INVENTION

1. Field of the Invention

The present invention relates to a smoke shield assembly for a cooking appliance and, more particularly, to a magnetically hinged smoke shield assembly for an over-the range oven, the assembly being secured to the oven by magnets.

2. Description of the Prior Art

Various exhaust and smoke/fume deflector systems for cooking appliances or other apparatus are known. The following patents depict several types of such systems. U.S. Pat. No. 3,180,331 shows an oven mounted above a counter top range, the oven having a pivotally movable duct that serves as a conduit for transmitting fumes, smoke and odors from the oven to an exhaust system disposed in the counter top range located below. U.S. Pat. No. 3,496,704 is directed to a hood for a pull-out drawer type of console range, the hood being constructed so as to be easily converted to allow ducted or duct-free discharge. U.S. Pat. No. 3,564,990 discloses a collapsible canopy for use in a laboratory for directing laboratory fumes to an exhaust duct. The collapsible canopy is designed to be mounted above a desk or table-top and includes a top plate pivotally connected by a hinge to an exhaust duct. The canopy further includes downwardly depending sides secured to the top plate by hinges. The canopy is movable from a collapsed position, in which the top plate hangs vertically under the influence of gravity, to an open position, in which the top plate extends horizontally and is maintained in that position by the vertically extending sides. U.S. Pat. No. 4,029,002 discloses a pivotally movable damper mounted in a hood above a range and movable about a damper rod between open and closed positions. The damper is supported for pivotal movement by a pair of outwardly extending stubs secured in apertures in the hood. U.S. Pat. No. 4,418,261 discloses a ventilator system for a microwave oven mounted above a conventional electric range. U.S. Pat. No. 2,739,521 shows an automatic damper for a ventilating system pivotally mounted in a duct or louver that includes a magnet to attract the damper in a closed position.

Patents which depict various magnetically attachable devices are as follows. U.S. Pat. No. 2,855,242 discloses a portable visor or sunscreen adapted for magnetic attachment to an interior metal trim strip adjacent the upper portion of an automobile windshield. U.S. Pat. No. 3,361,404 discloses a support assembly for attaching a sun shade or visor to a frame portion of an automobile above the windshield wherein the support assembly is magnetically attached to a support plate secured to the headliner of the automobile. U.S. Pat. No 3,043,289 is directed to a safety guard for concealing the petcocks of a gas range from small children. The safety guard includes a housing having top, bottom, front and side walls wherein the housing is secured to enclose on-off valves of a gas range by a plurality of magnets attached to the housing by bolts or the like. U.S. Pat. No. 3,912,473, shows a ring-shaped housing for a filter that may be attached to a fan grill by permanent magnets.

None of the above patents teach or suggest a smoke-/and fume deflector that can be readily mounted to an underside of an over-the-range microwave or conventional oven or to other over-the-range appliances or devices in which the deflector is also easy to clean, inexpensive and long lasting.

SUMMARY OF THE INVENTION

It is an object of the present invention to provide a new and improved smoke shield assembly and, more particularly, to provide a magnetically hinged smoke shield assembly adapted for an oven that is spaced above a cook top.

It is another object of the present invention to provide a new and improved smoke shield assembly that is easily mounted on a magnetically attractable material disposed above a cook top to deflect smoke and fumes from the cook top away from a user while the assembly is in an operative or "in use" position, the assembly having a stowed or stored position for when the assembly is not in use.

It is yet another object of the invention to provide a new and improved smoke shield assembly which is readily detachable from an upper oven for cleaning and which is readily reattachable to the oven for use.

Still another object of the invention is to provide a new and improved smoke shield assembly utilizing a permanent magnet for securing the assembly in place and for providing a hinge to allow a deflector shield to move between a stored position and a smoke and fume deflecting in use position.

Yet another object of the present invention is to provide a new and improved smoke shield assembly that includes a first magnetic means for attaching the assembly to a metal member disposed above a cook top and for providing a hinge to allow a deflector shield to move between a stored position and an in use position, the assembly including a second magnetic means to aid the first magnetic means in attaching the assembly to the metal member and for maintaining the deflector shield in a stored position.

Very briefly, the present invention is embodied in a new and improved smoke shield assembly for use with an over-the-range conventional or microwave oven or other appliance or device having a magnetically attractable member forwardly positioned on the bottom thereof above a range or cook top. The smoke shield assembly includes a magnetically attractable base and a plurality of permanent magnets for securing the base to the metal member of the over-the-range oven or the like. One or more of the magnets also forms a magnetic hinge to secure a metal deflector shield to the base, the shield being movable between stored and in use positions. One or more of the magnets further maintains the deflector shield in the stored position.

These and other objects, advantages and novel features of the present invention, as well as details of an illustrative embodiment thereof, will be more fully understood from the following description and the drawing.

DETAILED DESCRIPTION OF PREFERRED EMBODIMENTS

Figures 1, 2, 3, 4, 5:
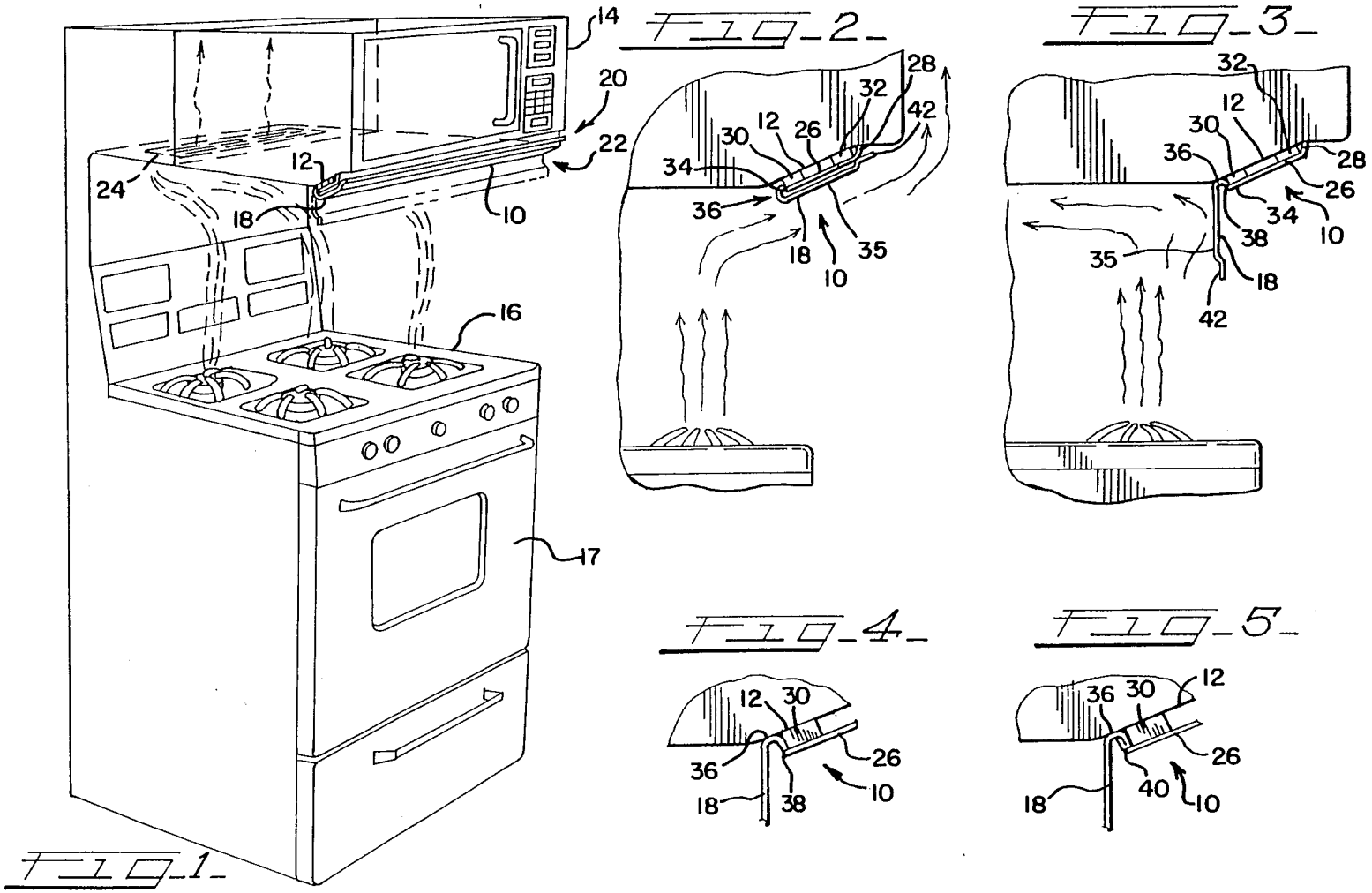
FIG. 1 is a front elevational view of a cooking center having a microwave oven spaced above a range or cook top with the smoke shield assembly of the present invention mounted on the oven.
FIG. 2 is an enlarged, fragmentary side elevational view of the cooking center of FIG. 1 depicting the smoke shield assembly in a stored position.
FIG. 3 is an enlarged, fragmentary view of the cooking center of FIG. 1 depicting the smoke shield assembly in an in use position.
FIG. 4 is an enlarged, fragmentary side elevational view of the smoke shield assembly shown in FIG. 3 and depicting a magnetic hinge for maintaining a pivot end of the deflector shield in contact with the base.
FIG. 5 is an enlarged, fragmentary side elevational view depicting an alternate embodiment of the pivot end of the deflector shield.

A smoke shield assembly 10 constructed in accordance with the principles of the present invention is mounted on a forward bottom surface 12 of an over-the-range microwave oven 14 to deflect smoke from a cook top 16 of a range 17, the cook top 16 being spaced below the oven 14 as shown in FIG. 1. More specifically, the assembly 10 includes a deflecting shield 18 that is pivotal between a stored position 20, shown in FIGS. 1 and 2, and an in use position 22, shown in FIG. 3 and in phantom in FIG. 1, for deflecting smoke from the cook top 16 away from a user towards an exhaust 24. Although the smoke shield assembly 10 is shown attached to an over-the-range microwave oven 14, the assembly 10 may also be mounted on a forward bottom surface of a conventional over-the-range oven separate from or integral with the range 17 or the assembly 10 may be mounted on a forward bottom surface of another appliance, kitchen cabinet or the like. The only requirement of the surface 12 to which the smoke shield assembly 10 is to be mounted on is that the surface be formed of a magnetically attractable material such as metal.

The smoke shield assembly 10 includes an elongated metal base 26 with an upwardly extending flanged end 28 that abuts the bottom surface 12 of the oven 14 when the assembly 10 is mounted on the oven 14. The smoke shield assembly 10 further includes four magnets, only two of which 30 and 32 are shown, for magnetically securing the base 26 to the bottom surface 12 of the oven 14. More specifically, the magnet 30 and an additional magnet (not shown) are disposed adjacent to a first edge 34 of the base 26; whereas, on an opposite end of the base 26 adjacent to the flanged end 28, the magnet 32 and another magnet (not shown) are mounted. The magnets 30 disposed adjacent to the edge 34 of the base 26 are offset from the edge 34 by a distance sufficient to support a pivot end 36 of the deflecting shield 18 as will be apparent from the discussion below.

The deflecting shield 18 is made of metal having an elongated portion 35 that extends the length of the base 26. One side of the portion 35 of the deflecting shield 18 forms a pivot end 36 that is generally U-shaped and may have an unhemmed edge 38 as shown in FIG. 4. Alternatively the pivot end 36 may have a hemmed edge 40 as shown in FIG. 5 to ease the pivoting of the deflecting shield 18 between stored and in use positions 20 and 22. The deflecting shield 18 also includes an offset upper flange portion 42 which extends outwardly from the portion 35 of the deflecting shield 18 past the flanged end 28 of the base 26 when the deflecting shield is in the stored position 20 so that the portion 42 may be easily grasped by a user to move the deflecting shield 18 between the stored position 20 and the in use position 22.

The magnets 30 disposed adjacent to the edge 34 of the base 26 secure the base 26 to the surface 12 of the oven 14 and further form a magnetic hinge to maintain the pivot end 36 of the deflecting shield 18 secured to the base 26 when the deflecting shield 18 is in the stored and in use positions 20 and 22 as well as when the deflecting shield 18 is moved between these positions 20, 22. The magnets 32 disposed adjacent to the flanged end 28 of the base 26 also secure the base 26 to the surface 12 of the oven 14 and further maintain the deflecting shield 18 in the stored position 20.

The smoke shield assembly 10 of the present invention may be readily installed on a microwave oven 14 used over a cook top 16 for which the oven 14 may not have been designed. The assembly 10 has no moving parts to wear out and is further maintenance free. The smoke shield assembly 10 is also easy to manufacture, easy to install and inexpensive. Further, the smoke shield assembly 10 is easy to clean in that the deflecting shield 18 may be readily removed from the base by lifting the shield 18 off. It is noted that the amount of force required to change the position of the smoke shield assembly 10 from either the stored position 20 or the in use position 22 may be varied by varying the strength, type or configuration of the magnets 30, 32; by varying the quantity and placement of the magnets; and by varying the amount of surface area in contact with the magnets. Further, as discussed above, the hemmed edge 40 of th deflecting shield 18 may pivot easier than the unhemmed edge 38.

Many modifications and variations of the present invention are possible in light of the above teachings. Thus, it is to be understood that, within the scope of the appended claims, the invention may be practiced otherwise than as described hereinabove.

What is claimed and is desired to be secured by Letters Patent is:

1. A smoke shield assembly attachable to a magnetically attractable member spaced above a cook top comprising:

a base made of a magnetically attractable material;

magnet means for securing said base to said member; and deflecting means for deflecting smoke from said cook top away from a user, said deflecting means having a pivot end made of a magnetically attractable material pivotally secured to said base by said magnet means for movement between a stored position and an in use position.

2. A smoke shield assembly as recited in claim 1 wherein said magnet means includes means for magnetically maintaining said deflecting means in said stored position.

3. A smoke shield assembly as recited in claim 1 wherein said base is made of metal.

4. A smoke shield assembly as recited in claim 1 wherein said deflecting means is made of metal.

5. A smoke shield assembly as recited in claim 1 wherein said magnet means includes a first permanent magnet disposed adjacent a first edge of said base to form a magnetic hinge to pivotally secure said deflecting means to said base; and a second permanent magnet disposed adjacent a second edge of said base to maintain said deflecting means in said stored position.

6. A smoke shield assembly attachable to a metal member spaced above a cook top comprising:

an elongated metal base having first and second edges;

first magnet means disposed adjacent to said first edge of said base for securing said base to said metal member;

second magnet means disposed adjacent to said second edge of said base for securing said base to said metal member; and an elongated metal deflector shield pivotally secured to said first edge of said base by said first magnet means for pivotal movement between a stored position and an in use position for deflecting smoke from said cook top, said deflector shield being maintained in said stored position by said second magnet means.

7. A smoke shield assembly as recited in claim 6 wherein said first magnet means includes at least two permanent magnets.

8. A smoke shield assembly as recited in claim 6 wherein said second magnet means includes at least two permanent magnets.

9. A smoke shield assembly as recited in claim 6 wherein said deflector shield has a generally U-shaped pivot end secured to said base by said first magnet means.

10. A smoke shield assembly as recited in claim 9 wherein said pivot end includes a hemmed pivot edge.

11. A smoke shield assembly attachable to a magnetically attractable member on a bottom surface of an over-the-range oven comprising:

a metal base;

magnet means for securing said base to said over-the-range oven member; and a metal deflector shield having a generally U-shaped pivot end secured to said base by said magnet means for pivotal movement between a stored position and an in use position for deflecting smoke, said deflector shield being maintained in said stored position by said magnet means.

12. A smoke shield as recited in claim 11 wherein said pivot end includes a hemmed pivot edge.

13. A smoke shield assembly as recited in claim 11 wherein said magnet means includes a first permanent magnet disposed adjacent to a first edge of said base to form a magnetic hinge to pivotally secure said deflector means to said base; and a second permanent magnet disposed adjacent to a second edge of said base to maintain said deflector means in said stored position.

* * * * *